United States Patent [19]

Siglock

[11] Patent Number: 4,949,018

[45] Date of Patent: Aug. 14, 1990

[54] HIGH PRESSURE SODIUM LAMP STARTER CONTROLLER

[75] Inventor: John V. Siglock, Sierra Madre, Calif.

[73] Assignee: Unicorn Electric Products, Anaheim, Calif.

[21] Appl. No.: 372,190

[22] Filed: Jun. 26, 1989

Related U.S. Application Data

[63] Continuation of Ser. No. 118,208, Nov. 6, 1987, abandoned.

[51] Int. Cl.[5] ..... H05B 37/00

[52] U.S. Cl. ..... 315/225; 315/119; 315/DIG. 7

[58] Field of Search ..... 315/225, DIG. 7, 153, 315/119

[56] References Cited

U.S. PATENT DOCUMENTS 4,242,614 12/1988 Vatis ..... 315/153

4,665,346 5/1987 Tarroux ..... 315/DIG. 7

*Primary Examiner*—Donald J. Yusko

*Assistant Examiner*—Michael Horabik

*Attorney, Agent, or Firm*—Christie, Parker & Hale

[57] ABSTRACT

A starter controller for a multiple parallel ballast for high pressure sodium lamps detects lamp "drop-out" or 'cycling" and enables restarting of the lamp if the drop-out was causded by line transients of a level sufficent to cause normally operating lamps to drop-out. If the detected lamp drop-out was caused by normal end-of-life conditions, the controller does not allow restarting of the lamp. In one embodiment, the starter controller constantly monitors the voltage across the lamp terminals. When lamp drop-out occurs, this voltage rises rapidly to the ballast open-circuit secondary voltage. This voltage is detected by a level detector and rate detector which then processes lamp voltage level and rate of change of voltage after the initial drop-out is sensed. If the drop-out was caused by a sudden line transient, a relatively low maximum voltage level occurs after a high rate of change of lamp voltage, and this sensed combination of voltage level and rate of change triggers a timing circuit to enable the starter to restart the lamp. If a relatively high voltage level is sensed in combination with a high rate of change of lamp voltage, this indicates that drop-out was caused by lamp aging and the lamp is not restarted.

29 Claims, 4 Drawing Sheets

HIGH PRESSURE SODIUM LAMP STARTER CONTROLLER

This is a continuation of application Ser. No. 118,208, filed Nov. 6, 1987, now abandoned.

FIELD OF THE INVENTION

This invention relates to ballast circuits for gas discharge lamps, and more particularly, to a controller for the starter circuit of a high pressure sodium vapor lamp ignition system.

BACKGROUND OF THE INVENTION

High pressure sodium vapor arc discharge lamps are commonly used for street lighting. The voltage necessary to ignite the arc in the gases in a sodium lamp is derived from a starter circuit connected across a ballast transformer. The starter circuit turns on a high pressure sodium lamp with high voltage narrow pulse width start-up signals. It can take approximately three to five minutes to stabilize the operating voltage of a high pressure sodium vapor lamp. This start-up time increases, and start-up voltage also increases, over the life of the lamp. For example, when first starting a lamp having a normal lamp voltage of 100 volts, the lamp voltage will be on the order of 25 volts RMS and will rise over about three to five minutes, as the lamp heats up, and will then level out at a stable voltage of about 100 volts. Over years of use, aging of the lamp causes this stable voltage level to progressively increase to about 160 volts, on the average. At this point the ballast will not be able to sustain ignition of the lam and the lamp becomes extinguished. This end-of-life condition is commonly referred to as lamp "drop-out", or "cycling", where the lamp flashes on and off but is unable to remain on continuously at normal power line supply voltages. The voltage at drop-out caused by an end-of-life condition can be as low as about 140 volts and as high as about 190 volts under various conditions, for a high pressure sodium lamp having a nominal lamp voltage of 100 volts.

In addition to lamp drop-out caused by aging, lamp drop-out, or cycling, also can occur from external conditions such as a sudden change in power line supply voltage. These voltage transients can cause a sudden drop in voltage below the level necessary to sustain ignition of the lamp.

When lamp drop-out occurs, the local utility can send service personnel to the site to correct the problem. If the cause of the lamp drop-out cannot be readily detected, service personnel often simply change the lamp, on the assumption that the problem was caused by an end-of-life condition. A lamp which is cycling can stay on for hours before going off again. Often service personnel respond to a reported lamp which is off, only to find that the lamp (which has cycled on) is now on. Since the service personnel cannot readily determine whether the lamp is truly cycling or whether drop-out may have been the result of other causes, the service personnel wait to see if the lamp cycles off. If it does not do so in a reasonable length of time, they may leave the site without changing the lamp, only to be called out again to replace the lamp which is later reported out. These service calls are time consuming and costly. Moreover, high pressure sodium lamps typically have a rated useful life of four to five years, they are expensive, and changing them prematurely adds significantly to the cost of operating the lighting system. In some instances the cost involved in responding to lamp drop-out problems is increased further where service personnel simply replace the entire lighting unit, i.e., the ballast, housing, starting aid, and lamp, in response to a lamp drop-out condition. Therefore, there is a need to identify a truly cycling lamp.

Several approaches to the lamp drop-out problem have occurred in the prior art. For instance, in U.S. Pat. No. 4,207,500 to Duve, et al., the lamp is permanently disabled, until manually reset, whenever the lamp voltage exceeds a certain voltage sometime after an initial delay after power-on. The delay is intended to sense a loss of power, but not necessarily a reduction of power below that required to sustain lamp operation. With the system in Duve, et al., it is possible for "brown outs" to cause all lamps in the circuit to remain out until service personnel manually reset all relays.

Another approach disclosed in U.S. Pat. No. 4,107,579 to Bodine, et al. simply includes an initial time delay after power-on to inhibit any action of the starting aid after the expiration of the delay period. This circuit is similar to Duve, et al. as to this aspect; but unlike Duve, et al., the circuit of Bodine, et al. is "reset" at every power-on sequence and does not need manual resetting. This system operates regardless of the condition of the lamp and is, in a sense, merely a timer. The purpose is to prevent placing undue voltage stresses on associated reactors or transformers when a lamp is defective or removed. However, the system in Bodine, et al. does not recognize when a lamp drop-out condition has occurred from a sudden power supply line reduction.

SUMMARY OF THE INVENTION

Briefly, this invention provides a starter controller which detects lamp drop-out, or cycling, and prevents the lamp which has dropped out from restarting if the lamp dropped out due to normal end-of-life conditions; but the controller allows the lamp to restart if drop-out was caused by line transients sufficient to cause a normally operating lamp to drop-out.

In one embodiment, the invention provides a starter controller for a gas discharge lamp comprising means for sensing an electrical output signal representative of lamp condition, i.e., whether the lamp is on or off; means for processing the output signal, in response to an indication that the lamp has dropped out, to discriminate between whether drop out was caused by power line transient conditions or a lamp aging condition; and means for enabling restarting of the lamp if the signal processing produces a first indication that lamp drop-out was caused by line transient conditions; and means for preventing restarting of the lamp if the signal processing produces a second indication that lamp drop-out was caused by a lamp aging condition.

In a preferred form of the invention, the starter controller senses the voltage across the terminals of the lamp to detect the lamp drop-out condition and detects the level and rate of change of lamp voltage to provide the indications of whether lamp drop-out was caused by power line transient conditions or a lamp aging condition.

Thus, the starter controller senses lamp drop-out and immediately processes the condition of the power supply to the lamp ballast system at or near the time of drop-out. When the signal processing indicates that the drop-out was caused by line voltage changes, the starter controller enables restarting of the lamp; whereas if the signal processing indicates that the drop-out was caused by normal end-of-life, the controller will not allow the lamp to restart. As a result, lamps that drop out due to power line transients can be immediately started, and trouble calls to service personnel can be avoided. Any lamps for which cycling is continually detected are thereby known to be extinguished by end-of-life and can be readily changed by service personnel. The result is a substantial cost savings to the servicing agency.

These and other aspects of the invention will be more fully understood by referring to the following detailed description and the accompanying drawings.

DETAILED DESCRIPTION

Figure 1:
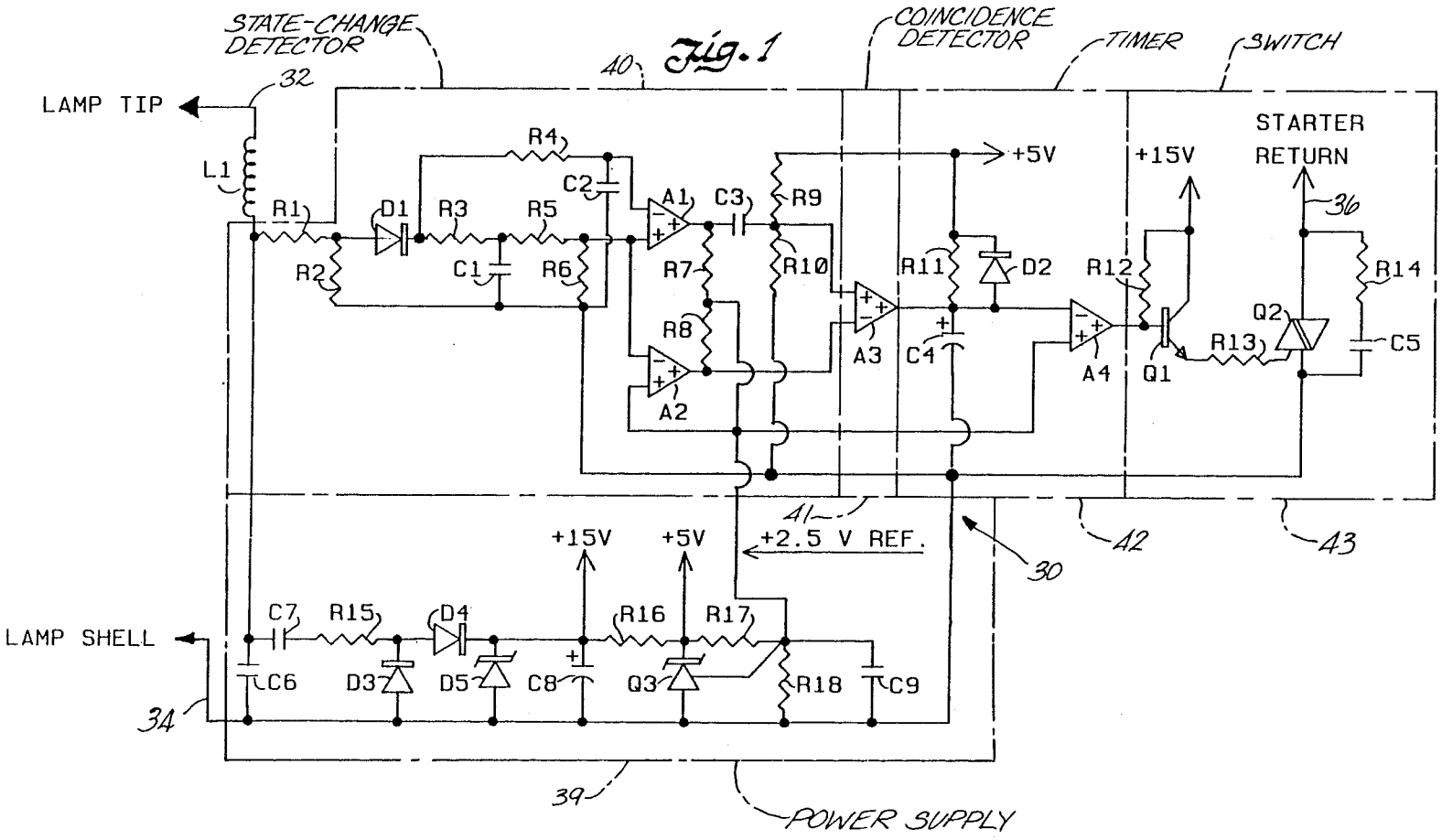
FIG. 1 is a schematic electrical diagram illustrating one embodiment of a lamp starter controller according the principles of this invention.

FIG. 1 is a schematic electrical diagram illustrating one embodiment of a starter controller for detecting and responding to lamp drop-out, or cycling, of a high-pressure sodium vapor lamp connected in a multiple parallel ballast system. The controller circuit illustrated in FIG. 1 can be implemented so as to control restarting of the lamp depending upon whether the lamp dropped out due to normal end-of-life conditions, or due to line transients sufficient to cause a normally operating lamp to drop out. The system includes means for detecting lamp status or condition, i.e., whether the lamp is on or off. When detected lamp status indicates that the lamp has gone off, i.e., is cycling or has dropped out. The system then processes output signals representative of lamp condition to discriminate between whether lamp drop out (or cycling) was caused by normal aging or a line transient. In the illustrated embodiment, the voltage across the terminals of the lamp is detected and processed to provide drop-out detection and further signal processing in order to discriminate as to the cause of the drop-out and then either restart the lamp if drop-out was due to line transient conditions, or prevent restarting the lamp if drop-out was due to normal end-of-life. Characteristically, the voltage across the lamp terminals will rise rapidly to the ballast open circuit secondary voltage, and the lamp current will decrease nearly to zero, when the lamp stops operating. In this instance, lamp status or condition is measured by lamp voltage. Although detection of drop-out could be accomplished optically, or by means of current detection or voltage detection, or by other similar means, the preferred embodiment described herein utilizes voltage detection and processing of voltage signals to accomplish its purpose, inasmuch as voltage detection is a positive means of determining the status of the power supply to the lamp-ballast system at the time of drop-out. However, a system for detection of drop-out and processing to control restarting of the lamp alone can be implemented to detect and process current signals, instead of voltage, without departing from the scope of the invention. Lamp drop-out also could be detected optically by detecting lamp intensity changes which are related to an indication of whether drop-out has occurred from aging or a sudden line transient.

Although detection using amplitude of the lamp voltage is a preferred means of detection, use of amplitude information alone is not the preferred means of detection. Use of voltage rate-of-change information in combination with voltage amplitude or level detection is the desired method. The reason is that under some lamp ballast conditions, such as reactor ballast with high line voltage and end-of-life lamp conditions, lamp voltage can actually be higher than the ballast open-circuit secondary voltage under other conditions, such as reactor ballast with low line voltage. The starter controller illustrated in FIG. 1 employs detection of lamp voltage and processes it according to voltage level and rate-of-change. As mentioned previously, it is characteristic of lamp drop-out that the voltage across the lamp terminals rises rapidly to the ballast open circuit secondary voltage at the time of drop-out. By detecting this rate of change and enabling a means to discriminate the lamp voltage at the conclusion of the high rate of change, it is possible to determine whether the lamp drop-out was due to normal lamp aging or due to a condition of the power supplied to the lamp.

FIGS. 2 through 7 show a family of curves illustrating voltage waveforms of various signals generated during operation of the controller circuit illustrated in FIG. 1. The first set of curves (on the left side of the drawings) represents a normally operating lamp. The middle set of curves illustrates voltage waveforms associated with lamp aging conditions. The third set of curves (on the right side of the drawings) illustrates voltage waveforms associated with lamp cycling due to voltage supply line transients. Operation of the controller circuit of FIG. 1 will be described below in conjunction with the voltage waveform signals illustrated in FIGS. 2 through 7.

Figure 8:
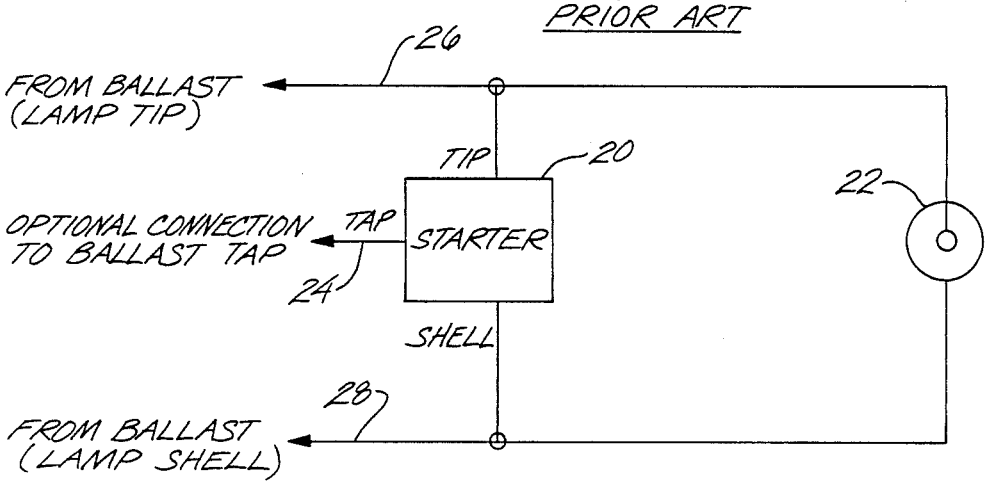
Fig. 8 PRIOR ART
FIG. 8 is a schematic block diagram illustrating connections of a prior art starter aid to a ballast transformer.

FIG. 8 is a block diagram illustrating a prior art starter circuit or starter aid 20 for a high pressure sodium vapor arc discharge lamp 22. The lamp 22 and the starter circuit 20 are connected in parallel across the voltage output of a ballast transformer (not shown). The ballast may include a primary coil and secondary coil, or tertiary coil (not shown). The presence of an optional connection to the ballast tap 24 depends upon the style of starting aid. One terminal 26 is connected to the lamp tip, and the other terminal 28 is connected to the lamp shell to provide a ground connection.

Figure 9:
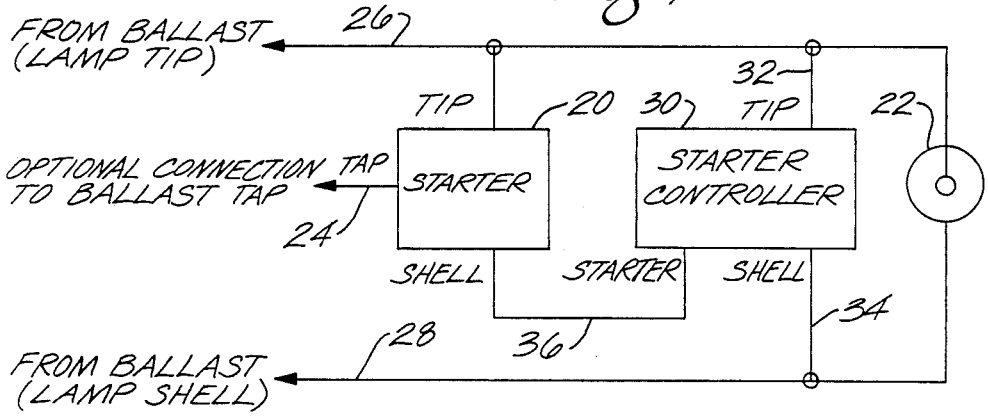
FIG. 9 is a schematic block diagram illustrating connection of the starter controller of this invention to a separate starter circuit for a ballast transformer.

FIG. 9 is a block diagram illustrating one embodiment of a system for connecting the starter controller of this invention to the starter circuit 20 of a multiple parallel ballast system for the sodium vapor lamp 22. In the illustrated system, the starter controller represented by the block diagram 30 has one output terminal 32 connected in parallel with the starter circuit to the ballast terminal 26 for the lamp tip. The opposite output terminal 34 of the starter controller is connected to the ballast terminal 28 for the lamp shell. The starter controller 30 can permit or inhibit start pulses which are supplied by the starter circuit 20 through an output line 36.

Figure 10:
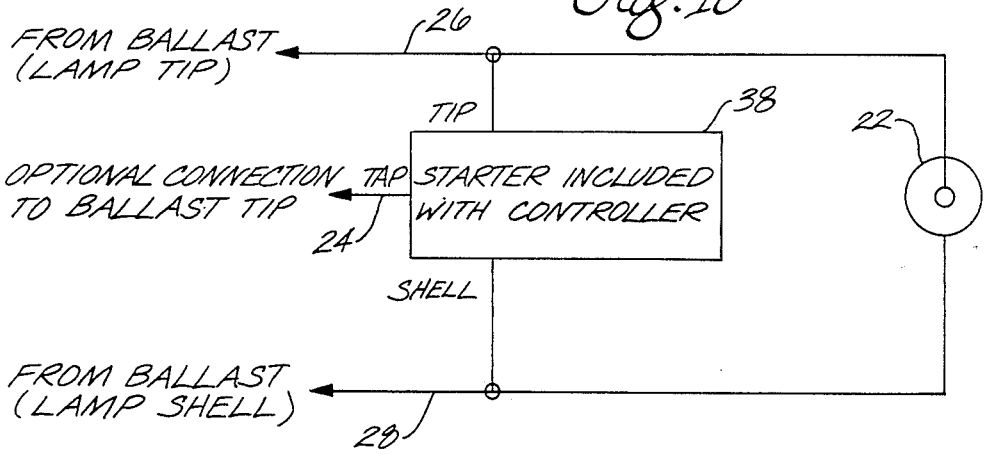
FIG. 10 is a schematic block diagram illustrating an alternative embodiment in which the starter controller of this invention is included within the starter circuit connected across the ballast transformer.

FIG. 10 is an alternative embodiment in which a combined starter and controller 38, comprising a conventional starter aid included with the controller of this invention, are coupled in parallel to the ballast along with the sodium vapor lamp 22.

Figure 1A:
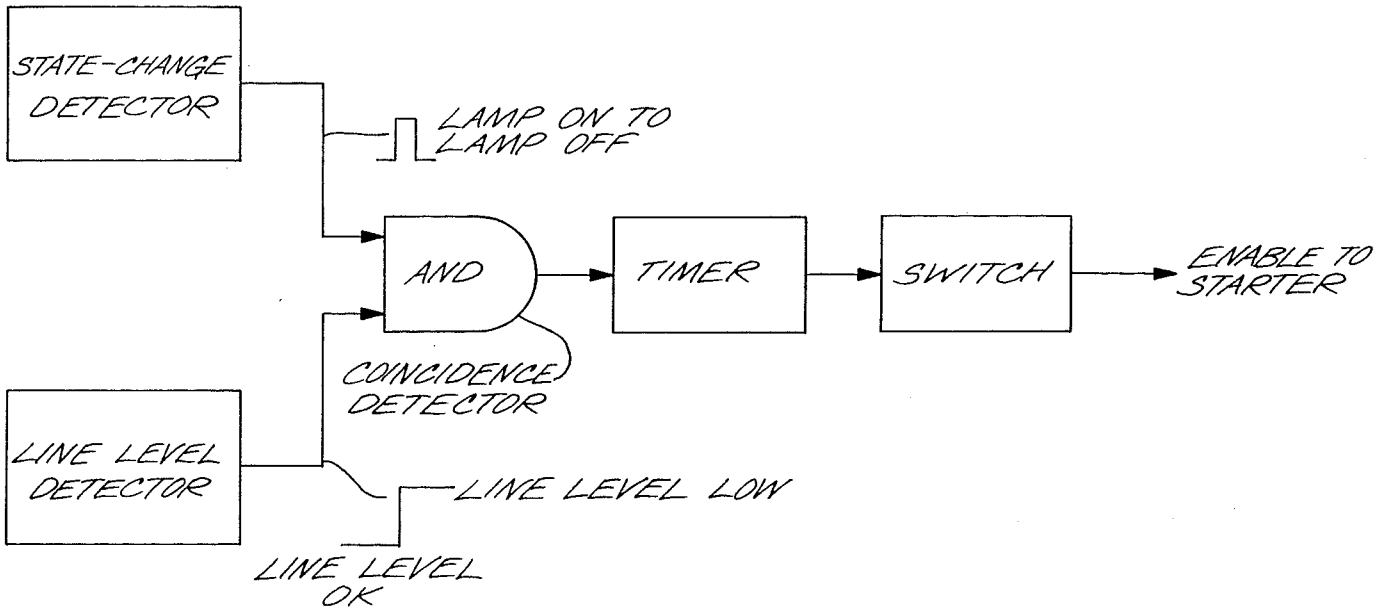
FIG. 1A is a functional block diagram illustrating general principles of operation of the lamp starter controller.

The basic principles of operation of the lamp starter controller are understood best by first referring to FIG. 1A which is a functional block diagram of the starter controller circuit. The circuit measures either the power line voltage or preferably the ballast open circuit voltage via the line level detector immediately after the state-change detector indicates that the lamp has changed from the ON state to the OFF state in response to an output signal to the state-change detector. If the power line voltage or ballast open circuit voltage level is less than a preestablished minimum level, then line voltage variations may have been responsible for the extinguishing of the lamp and the lamp will therefore be allowed to restart. However, if the line voltage level is above the predetermined reference level, then the lamp has "cycled" or dropped out due to the normal aging of the lamp and will not be allowed to restart. Since the lamp will not be able to reignite immediately in either case (a "hot restart" condition) the start pulses must be available for a minimum of one minute, but the starter must be inhibited after the lamp reignites in order for the invention to function. Thus, either a timer or a "toggle" may be used for this purpose. The toggle allows the starter to function until the lamp starts and then inhibits further start pulses subject to the action of the detectors of the starter circuit. The timer or toggle acts through a switch circuit to allow starter operation.

Operation of the starter controller circuit 30 of FIG. 1 will be described by referring to the electrical schematic diagram of FIG. 1 in conjunction with the voltage waveforms illustrated in FIGS. 2 through 7. The starter controller circuit 30 includes the following: a power supply 39, state-change detector 40, coincidence detector 41, timer 42, and switch 43. An inductance L1 (which is part of the power supply) in conjunction with a capacitor C6, couples the fundamental line frequency to the controller circuit while attenuating the high voltage narrow pulse width starting pulses to prevent overloading of other components in the circuit and to prevent "loading" of the starting pulses. A capacitor C7 stores charge due to the action of a diode D3 when the line is negative and the capacitor C7 transfers the charge to a capacitor C8 through a diode D4 when the line polarity is positive. A resistor R15 limits the current and a Zener diode D5 limits the voltage. A precision voltage reference Q3 in conjunction with resistors R16, R17, and R18 and a capacitor C9 provide stable reference voltages of 2.5 volts and 5 volts for circuit operation that are essentially independent of line voltage variations.

Figure 3:
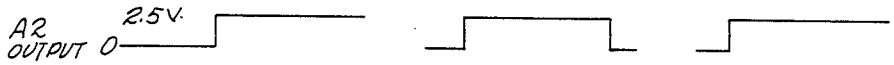
Figure 4:
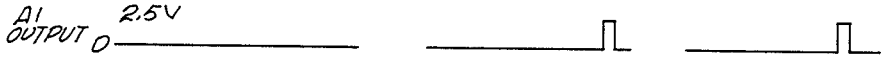
Figure 5:
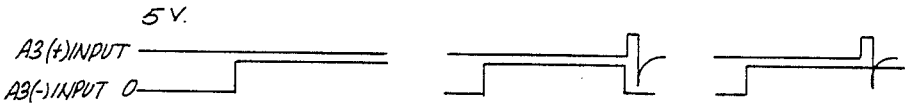
Figure 6:
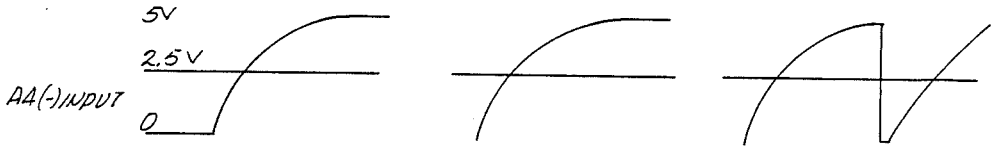
Figure 7:
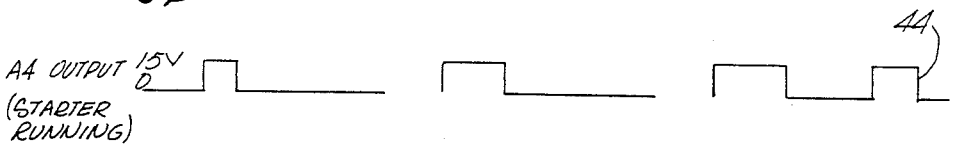

Referring to the controller portion of the circuit diagram in FIG. 1, a Triac Q2 enables operation of the starter circuit 20 by switching the starter circuit's "return" or common line 36, which is coupled to the lamp "shell" or screw connection, i.e., the low side of the circuit. A "quad comparator" integrated circuit is used in the illustrated circuit, although those skilled in the art will recognize that other circuit components are available for this application. The particular integrated circuit in the illustrated embodiment is an open-collector device available as an LM2901N quad comparator. Each comparator is referred to by circuit elements A1, A2, A3 and A4. During normal operation of the circuit, the comparator A3 is used to discharge a capacitor C4 to ground potential to allow starting pulses for starting the lamp. The capacitor C4 is normally charged to 5 volts by a resistor R11. However, during the time that the inverting (negative) input to the comparator A4 is less than the 2.5 volt reference applied to the non-inverting (positive) input of the comparator, the comparator A4 will be in the non-conducting output state and will allow a resistor R12 to bias a transistor Q1 to the "on" state. This supplies current to the gate of the Triac Q2, causing the Triac to conduct and allowing the starting circuit to function. A diode D2 discharges the capacitor C4 when the 5 volt supply is not functioning, providing the initial opportunity for the starter circuit to start the lamp at "power-on" conditions. In order for the output signal from the comparator A3 to discharge the capacitor C4, the inverting input to the comparator A3 must be more positive than its non-inverting input. FIG. 5 illustrates the control signals to the inverting and non-inverting inputs of the comparator A3. The non-inverting input of the comparator A3 receives a control signal output from the comparator A2 which acts as a voltage level detector. The output from the comparator A2 is shown in FIG. 3. The non-inverting input of the comparator A3 receives a control signal output from the comparator A1 which acts as a voltage rate detector. The output from the comparator A1 is illustrated in FIG. 4. Cycling caused by end-of-life of the lamp causes the lamp voltage rate of change to rise rapidly and also causes the lamp voltage level to rise above a known level. The output signals from the voltage level and rate comparators A2 and A1 are input to comparator A3 which detects when these two conditions coincide. Cycling caused by a sudden drop in line voltage causes the lamp voltage rate to rise rapidly. Voltage level rises, but does not exceed the level caused by end-of-life. The comparator A3 detects when the rise in lamp voltage level and rate of change are caused by line transients. In the illustrated control circuit, the combination of a voltage rate-of-change rise and a rise in voltage level that does not exceed a pre-set amplitude threshold causes the inverting input of the comparator A3 to exceed its non-inverting input. This condition causes the output of comparator A3 to change state, producing an output pulse which discharges the capacitor C4. This, in turn, causes a change of state of the comparator A4 which generates a start signal 44 shown in the waveform of FIG. 7. This start signal is fed to the starter circuit 20 through Q1 and Q2 for automatically restarting the lamp. If the combined voltage level and rate signals indicate an end-of-life condition, the non-inverting input to the comparator A3 exceeds its inverting input, the capacitor C4 is not discharged, and no start signal is generated.

Figure 2:
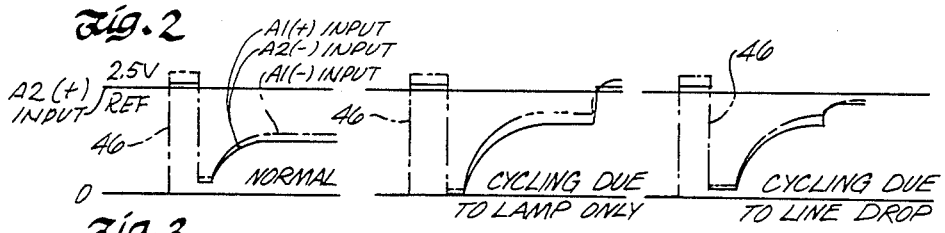
FIGS. 2 through 7 are graphical representations of voltage waveforms present during operation of the circuit illustrated in FIG. 1.

Resistors R1 and R2 attenuate the lamp voltage to levels that will not damage the detector diode D1. The resistors R1 and R2 also attenuate the lamp voltage to the input stage resistor R3 and capacitor C1 to provide an attenuated and rectified (detected) representation of the voltage present at the lamp terminals. Resistors R5 and R6 further attenuate this voltage and supply it to the comparators A1 and A2. The inverting input of the comparator A2 receives one of the voltage waveforms illustrated in FIG. 2, depending upon lamp status, i.e., whether the voltage is from a normal lamp, or is caused by cycling due to lamp aging, or is caused by cycling due to a power line voltage drop. The initial high-voltage portion 46 of each voltage waveform in FIG. 2 represents the initial start-up conditions. The lamp voltage at this point in the cycle is the ballast open circuit secondary voltage which occurs at the time of drop-out. Following lamp starting, the voltage waveforms illustrate how the lamp voltage initially drops suddenly and then rises to a stable voltage. The positive input to the comparator A2 is a stable 2.5 volt reference. The curves shown in phantom lines in FIG. 2 represent the input voltage waveform to the inverting input of the rate comparator A1. The voltage waveforms illustrated in solid lines in FIG. 2 represent the more attenuated input signals to the non-inverting input of the comparator A1 and the inverting input of the comparator A2. The curves in FIG. 2 illustrate how the voltage across the terminals of the lamp which has experienced end-of-life conditions levels out at a higher level than a normal lamp and then rises suddenly to a level greater than the preset 2.5 volt reference level. On the other hand, the voltage across the terminals of a lamp which has experienced drop-out from a sudden drop in line voltage also levels off to a stable value and then experiences a sudden rise in voltage which then stabilizes at a maximum level less than the amplitude threshold represented by the 2.5 volt reference.

The comparator A3 is part of a differentiator circuit which also includes a capacitor C3 and the resistors R9 and R10. The output terminals of the comparators A1 and A2 are coupled by pull-up resistors R7 and R8. The level comparator A2 compares the voltage at resistors R5, R6 with the 2.5 volt reference supplied to its non-inverting input. Due to the action of the pull-up resistor R8, comparator A2 provides an input of 2.5 volts to the non-inverting input of comparator A3 whenever the detected lamp voltage at resistors R5, R6 does not exceed the 2.5 volt reference applied to the non-inverting input of the comparator A2. The comparator A2 provides a nearly ground potential at all other times. FIG. 3 illustrates the voltage waveforms from the output of the comparator A2 for the different lamp conditions.

The detector diode D1 also supplies current to resistor R4 and capacitor C2. The time constant of the R4, C2 circuit is significantly greater (approximately 5 to 10 times) than the time constant of the R3, C1 circuit. Comparator A1 compares the detected lamp voltage provided by the R4, C2 circuit to the faster time constant of the R3, C1 circuit which, in turn, has been attenuated by resistors R5 and R6. Due to the action, of resistors R5 and R6, the output of the rate comparator A1 is normally conducting for changes in lamp voltage that are slower than the time constant of the R3, C1 circuit. However, when the voltage changes suddenly, as it does at drop-out, the voltage at resistors R5 and R6 exceeds that at the R4, C2 circuit while the voltage is increasing. At this time, the output from the comparator A1 is not conducting and resistor R7 "pulls-up" the output to the 2.5 volt reference. Resistors R9 and R10 provide a voltage divider for supplying approximately 3.0 volts to the non-inverting input of the comparator A3. The voltage input to the non-inverting input of comparator A3 is shown in FIG. 5. During the time that the output of comparator A3 is positive, a capacitor C3 supplies a charge to the junction of resistors R9 and R10 causing it to become more positive. However, when the output of the comparator A3 is conducting again (end of high rate of increase of lamp voltage), the capacitor C3 is discharged, thereby causing the voltage at the R9, R10 junction to be reduced to about 0.5 volts until the R9, R10 voltage divider charges capacitor C3 again to 3.0 volts. This circuit thus acts as a differentiator circuit.

During the time that the non-inverting input of comparator A3 is reduced by the differentiator circuit (i.e., at the time immediately after the high rate of increase of the lamp voltage has ended), if the comparator A2 is not conducting (because the detected voltage at R5, R6 is not sufficient to exceed the 2.5 volt reference), the comparator A3 will switch to the conducting mode, thereby discharging the capacitor C4 and initiating a "timing" circuit comprised of a resistor R11 and the capacitor C4. This causes the comparator A4 to allow the transistor Q1 to conduct for gating the Triac Q2 which, in turn, enables the starter circuit to provide start pulses to allow lamp reignition. This condition represents a power line reduction causing the lamp to drop out. On the other hand, if the comparator A2 is conducting, level comparator A3 will not be able to switch to the conducting state and no start pulses will be provided for the lamp to restart. This condition represents cycling due to normal end-of-life conditions.

Thus, the rate detector A1 through the differentiator R9, R10, C3 provides a "time window" for the level detector provided by the comparator A2. The coincidence of a low voltage level immediately after a high voltage rate enables a timing circuit provided by comparator A4 to allow restarting for drop-out caused by line voltage changes. On the other hand, if the lamp cycles due to normal end-of-life, the level detector provided by comparator A2 will not detect low levels (the open circuit secondary voltage being greater than the allowed minimum) and the lamp will not be allowed to restart. In summary, the starter controller of this invention not only detects lamp drop-out but also provides signal processing evaluating the condition of the power supply to t ballast system at or near the time of lamp to either allow restarting or prevent it upon whether the lamp was caused to drop out of line conditions or aging.

It should apparent to skilled in the art that the starter controller can to inhibit the starter circuit by various can specifically interrupt any lead of available starting aids, or otherwise inhibit the of the starter circuit. The controller also can incorporate a starting circuit on its own as illustrated in FIG. 10. It should also be apparent to those skilled art that the power supplied to the system could by other means, including but not limited to providing specific terminations and circuits t such measurements. The inclusion of the rate detection and the use of the ballast open c secondary voltage as an indication of the status of power lines at the time of drop-out are useful be in the case of the included starting aid embodiment, they yield a system which can be easily by field personnel familiar with currently a starting aid wiring and installation.

Examples of component for the circuit components illustrated in 1 are listed below. These circuit values are for a 100 volt nominal lamp voltage, unless otherwise indicated.

Examples of Component Values

| | | | | | |
|---|---|---|---|---|---|
| R1 | 475,000 ohm | 1% | C1 | 0.1 microfarads | 50 volts |
| R2* | 8,200 ohm | 5% | C2 | 0.1 microfarads | 50 volts |
| R3 | 475,000 ohm | 1% | C3 | 0.1 microfarads | 50 volts |
| R4 | 4,700,000 ohm | 5% | C4 | 22 microfarads | 10 volts |
| R5 | 475,000 ohm | 1% | C5 | 0.01 microfarads | 600 volts |
| R6 | 4,700,000 ohm | 5% | C6 | 0.01 microfarads | 600 volts |

-continued

| Examples of Component Values | | | | | |
|---|---|---|---|---|---|
| R7 | 220,000 ohm | 5% | C7* | 0.47 microfarads | 400 volts |
| R8 | 220,000 ohm | 5% | C8 | 22 microfarads | 16 volts |
| R9 | 220,000 ohm | 5% | C9 | 0.1 microfarads | 50 volts |
| R10 | 330,000 ohm | 5% | | | |
| R11 | 4,700,000 ohm | 5% | D1 | 1N914 | |
| R12 | 27,000 ohm | 5% | D2 | 1N914 | |
| R13 | 470 ohm | 5% | D3 | 1N4007 | |
| R14 | 100 ohm | 5% | D4 | 1N4007 | |
| R15 | 100 ohm | 5% | D5 | 1N5245B 15 volt Zener diode | |
| R16 | 1,000 ohm | 5% | | | |
| R17 | 47,500 ohm | 1% | Q1 | 2N2222A | |
| R18 | 47,500 ohm | 1% | Q2 | MAC 97B-8 600 volt, 0.6 amp Triac | |
| | | | Q3 | TL 431 AIP Precision voltage ref. | |

L1 60 millihenry inductor
A1, A2, A3, A4 LM2901N Quad Comparator
*Note: For operation with 50-55 volt lamps change to:

| | | | | | |
|---|---|---|---|---|---|
| R2 | 15,000 ohm | 5% | C7 | 1.0 microfarads | 250 volts |

What is claimed is:

1. A starter controller for a gas discharge lamp, in which the lamp has a pair of lamp input terminals connected across the output of a ballast, in which a lamp starter supplies starting signals to the lamp, and in which a starter controller is coupled to the lamp starter for controlling the starting signals to the lamp, the starter controller comprising:

state-change detector means having input terminals for connection across the input terminals of the lamp for detecting an electrical signal proportional to the state of the lamp voltage normally present across the lamp input terminals, wherein said lamp voltage undergoes a rapid rise when a lamp drop-out condition occurs either as a result of a power line transient condition sufficient to cause a normally operating lamp to drop out, or as a result of a lamp aging condition, and the electrical signal detected across the input terminals of the state-change detector means measures the presence of said rapid rise in lamp voltage;

means responsive to the electrical signals present across the input terminals of the lamp for measuring and processing the detected electrical signals from the lamp, following a detection of said lamp drop-out condition by the state-change detector means, said electrical signal being proportional to the state of the lamp voltage wherein a first lamp voltage level is produced when the lamp drop-out condition was caused by a power line transient condition and a second lamp voltage level is produced when the lamp drop-out condition was caused by a lamp aging condition;

means for generating a start signal to the lamp starter for enabling restarting of the lamp in response to the processed electrical signal producing a first indication that the lamp drop-out condition was caused by power line transient conditions; and means for preventing restarting of the lamp in response to the processed electrical signal producing a second indication that the lamp drop-out condition was caused by the lamp aging condition.

2. A controller according to claim 1 in which the processing means produces said first indication in response to a detected rate of change of the electrical signal and a detected level of said electrical signal; and in which the second indication is produced by a detected rate change of the electrical signal and a second detected level of said electrical signal which differs measurably from the first detected level.

3. A controller according to claim 2 in which the processing means includes a level detection means in which the electrical signal level from the lamp is compared with a preset reference level, and in which a detected level on one side of the referenced level indicates a power line transient condition, and in which a detected level on the other side of the reference level indicates a lamp aging condition.

4. A controller according to claim 1 in which the starter controller controls starting of a high-pressure sodium vapor lamp.

5. A controller according to claim 1 in which the starter controller controls starting of a lamp in a multiple parallel ballast system.

6. A controller according to claim 5 in which lamp drop-out is detected when the electrical signal from the lamp exceeds the minimum required ballast open-circuit secondary voltage.

7. A controller according to claim 1 in which the detected electrical signal is lamp voltage.

8. A controller according to claim 1 in which the detected electrical signal is lamp current.

9. A controller according to claim 1 in which the detected electrical signal is lamp intensity.

10. Apparatus according to claim 1 in which the lamp has a lamp tip and a lamp shell, and the input terminals of the starter controller are connected across the lamp tip and the lamp shell.

11. Apparatus according to claim 1 in which the starter controller further includes a separate means for measuring powerline voltage is sufficient to permit the lamp to start.

12. A starter circuit for a gas discharge lamp having a pair of lamp terminals connected across the output of a ballast, and a lamp starter for supplying starting signals to the lamp, and in which the starter controller is coupled to the lamp starter for controlling the starting signals to the lamp, the starter controller comprising:

state-change detector means having input terminals for connection across the input terminals of the lamp for detecting the state of the voltage which is normally present across the terminals of the lamp, wherein said lamp voltage undergoes a rapid rise when a lamp drop-out condition occurs either as a result of a power line transient condition sufficient to cause a normally operating lamp to drop out, or as a result of a lamp aging condition;

the state-change detector means including means for measuring the rate of change of the lamp voltage and the level of the lamp voltage following detection of said rapid rise in lamp voltage;

means for generating a starting signal to the lamp starter for enabling restarting of the lamp in response to the measured lamp voltage level and rate of change of lamp voltage, in combination, producing a first indication that lamp drop-out was caused by the line transient conditions; and means for preventing restarting of the lamp in response to the measured lamp voltage level and rate of change of lamp voltage, in combination, producing a second indication that lamp drop-out was caused by the lamp aging condition.

13. A controller according to claim 12 in which the first indication is produced by a detected increase in the rate of change of lamp voltage and a first detected lamp voltage level below a preset reference voltage level; and in which the second indication is produced by a detected increase in the rate of change of lamp voltage and a second detected lamp voltage level greater than said preset reference voltage level.

14. A controller according to claim 13 in which the starter controller controls starting of a high-pressure sodium vapor lamp.

15. A controller according to claim 12 in which the controller controls starting of a lamp in a multiple parallel ballast system.

16. A controller according to claim 12 in which lamp drop-out is detected when the lamp voltage exceeds the minimum required ballast open-circuit secondary voltage.

17. Apparatus according to claim 12 in which the lamp has a lamp tip and a lamp shell, and the input terminals of the starter controller are connected across the lamp tip and the lamp shell.

18. Apparatus according to claim 12 in which the starter controller further includes a separate means for measuring powerline voltage is sufficient to permit the lamp to start.

19. In a starter circuit for a gas-discharge lamp having lamp terminals and the lamp starter both connected in parallel across a lamp ballast, a starter controller coupled to the lamp starter for detecting lamp drop-out, and thereafter controlling the lamp starter for either enabling or preventing restarting of the lamp, depending upon the condition of the lamp at drop-out, the starter controller comprising:

state-change detector means having input terminals for connection across the input terminals of the lamp for detecting an electrical signal proportional to the state of the lamp voltage normally present across the lamp input terminals, wherein said lamp voltage undergoes a rapid rise when a lamp drop-out condition occurs either as a result of a power line transient condition sufficient to cause a normally operating lamp to drop out, or as a result of a lamp aging condition, and the electrical signal detected across the input terminals of the state-change detector means measures the presence of said rapid rise in lamp voltage;

means responsive to the electrical signal present across the input terminals of the lamp for measuring and processing the detected electrical signal from the lamp, following a detection of said lamp drop-out condition by the state-change detector means, said electrical signal being proportional to the state of the lamp voltage wherein a first lamp voltage level is produced when the lamp drop-out condition was caused by a power line transient condition and a second lamp voltage level is produced when the lamp drop-out condition was caused by a lamp aging condition;

means for generating a start signal to the lamp starter for enabling restarting of the lamp in response to the processed electrical signal producing a first indication that the lamp drop-out condition was caused by power line transient conditions; and means for preventing restarting of the lamp in response to the processed electrical signal producing a second indication that the lamp drop-out condition was caused by the lamp aging condition.

20. Apparatus according to claim 19 in which the first indication is produced by a detected increase in the rate of change of the electrical signal and a first detected level of said output signal; and in which the second indication is produced by a detected increase in the rate of change of the electrical signal and a second detected level of said output signal which differs measurably from the first detected level.

21. Apparatus according to claim 19 in which the processing means includes means for comparing the electrical signal level with a preset reference level, in which a detected level on one side of the reference level indicates a power line transient condition, and in which a detected level on the other side of the reference level indicates a lamp aging condition.

22. Apparatus according to claim 19 in which the starter controls starting of a high-pressure sodium vapor lamp.

23. Apparatus according to claim 19 in which the means for detecting lamp drop-out senses the voltage across the terminals of the lamp.

24. Apparatus according to claim 23 in which lamp drop-out is detected when the lamp voltage exceeds the minimum required ballast open-circuit secondary voltage.

25. Apparatus according to claim 23 in which restarting of the lamp is enabled if detected lamp voltage level and lamp voltage rate of change, in combination produce said first indication; and in which restarting of the lamp is prevented is detected lamp voltage and lamp voltage rate of change, in combination, produce the second indication.

26. Apparatus according to claim 19 in which the means for detecting lamp drop-out measures lamp current.

27. Apparatus according to claim 19 in which the means for detecting lamp drop-out measures lamp intensity.

28. Apparatus according to claim 19 in which the lamp has a lamp tip and a lamp shell, and the input terminals of the starter controller are connected across the lamp tip and the lamp shell.

29. Apparatus according to claim 19 in which the starter controller further includes a separate means for measuring powerline voltage is sufficient to permit the lamp to start.

* * * * *

UNITED STATES PATENT AND TRADEMARK OFFICE

CERTIFICATE OF CORRECTION

PATENT NO. : 4,949,018

DATED : August 14, 1990

INVENTOR(S) : John V. Siglock

It is certified that error appears in the above-identified patent and that said Letters Patent is hereby corrected as shown below:

On the title page:

Abstract, line 3, change "'cycling" to -- "cycling" --.
Abstract, line 4, change "causded" to -- caused --.

Column 1, line 33, change "lam" to -- lamp --.

Column 8, line 38 delete "t" and after"to"and before "ballast" insert -- the lamp --.
Column 8, line 41, after "should" and before "apparent" insert -- be --.
Column 8, line 41, after "to" and before "skilled" insert -- those --.
Column 8, line 42, after "can" and before "to" insert -- function --.
Column 8, lines 42,43, after "various" and before "can" insert -- means which --.
Column 8, line 44, after "the" and before "of" insert -- action --.
Column 8, line 48, after "could" and before "by" insert -- be measured --.
Column 8, line 49, after "circuits" and before "such" delete the "t" and insert -- to provide --.
Column 8, line 50, before "detection" change "rate" to -- rate-of-change --.
Column 8, line 51, after "open" delete the "c" and insert -- circuit --.
Column 8, line 52, after "of" and before "power" insert -- the --.

UNITED STATES PATENT AND TRADEMARK OFFICE

CERTIFICATE OF CORRECTION

PATENT NO. : 4,949,018

DATED : August 14, 1990

INVENTOR(S) : John V. Siglock

It is certified that error appears in the above-identified patent and that said Letters Patent is hereby corrected as shown below:

Column 8, line 53, after "useful" and before "in" change "be" to -- because --.
Column 8, line 54, after "easily" and before "by" insert -- installed --.
Column 8, line 55, after "currently" delete "a" and insert -- available --.
Column 8, line 57, after "component" and before "for" insert -- values --.
Column 8, line 58, after "in" and before "1" insert -- FIG. --.
Column 8, line 59, before "for a 100" insert -- given --.

Column 8, lines 41-60 should read as follows:

-- It should be apparent to those skilled in the art that the starter controller can function to inhibit the starter circuit by various means which can specifically interrupt any lead of commonly available starting aids, or otherwise inhibit the action of the starter circuit. The controller also can incorporate a starting circuit on its own as illustrated in FIG. 10. It should also be apparent to those skilled in the art that the power supplied to the system could be measured by other means, including but not limited to providing specific terminations and circuits to provide such measurements. The inclusion of the rate-of-change detection and the use of the ballast open circuit secondary voltage as an indication of the status of the power lines at the time of drop-out are useful because in the case of the included starting

UNITED STATES PATENT AND TRADEMARK OFFICE

CERTIFICATE OF CORRECTION

PATENT NO. : 4,949,018

DATED : August 14, 1990

INVENTOR(S) : John V. Siglock

It is certified that error appears in the above-identified patent and that said Letters Patent is hereby corrected as shown below:

aid embodiment, they yield a system which can be easily installed by field personnel familiar with currently available starting aid wiring and installation.

-- Examples of component values for the circuit components illustrated in FIG. 1 are listed below. These circuit values are given for a 100 volt nominal lamp voltage, unless otherwise indicated. --

Column 9, lines 43,45, change "signals" to -- signal -- (both occurrences).

Column 12, line 41, before "detected" change "is" to -- if --.

Signed and Sealed this

Twelfth Day of May, 1992

*Attest:*

*Attesting Officer*

DOUGLAS B. COMER

*Acting Commissioner of Patents and Trademarks*